US006598911B2

(12) United States Patent
Mejean et al.

(10) Patent No.: US 6,598,911 B2
(45) Date of Patent: Jul. 29, 2003

(54) LATCH ARRANGEMENT

(75) Inventors: Veronique Mejean, Saint Die (FR); Mathias Barth, Azerailles (FR); Lutz Lorenz, Ingolstadt (DE)

(73) Assignee: ArvinMeritor Light Vehicle Systems (GB)

( * ) Notice: Subject to any disclaimer, the term of this patent is extended or adjusted under 35 U.S.C. 154(b) by 0 days.

(21) Appl. No.: 10/201,550

(22) Filed: Jul. 23, 2002

(65) Prior Publication Data

US 2003/0034655 A1 Feb. 20, 2003

(30) Foreign Application Priority Data

Aug. 1, 2001 (GB) ..... 0118687

(51) Int. Cl.[7] ..... E05C 3/06
(52) U.S. Cl. ..... 292/201; 292/216
(58) Field of Search ..... 292/201, 216, 292/144, DIG. 23; 70/264

(56) References Cited

U.S. PATENT DOCUMENTS 5,020,838 A 6/1991 Fukumoto

FOREIGN PATENT DOCUMENTS

GB 2 216 588 A 10/1989
GB 2 276 416 A 9/1994
GB 2 284 635 A 6/1995

OTHER PUBLICATIONS

Patents Act 1977, Search Report under Section 47 mailed Nov. 29, 2001.

*Primary Examiner*—Gary Estremsky
(74) *Attorney, Agent, or Firm*—Carlson, Gaskey & Olds

(57) ABSTRACT

A latch arrangement including a latch bolt having at least an open and closed position for releasably retaining a striker in use, the latch bolt being releasably held in at least a closed position by a pawl, the pawl being operably connected to an actuator by a transmission path, such that powered actuation of the actuator causes the pawl to release the latch bolt for opening, the latch arrangement further including means operable to return the actuator to a rest position, independent of movement of the pawl, wherein there is a lost motion connection in the transmission path to provide for the return of the actuator to the rest position independent of movement of the pawl, the lost motion connection being in the form of an abutment on a nut in lost motion connection with a further abutment of the transmission path.

8 Claims, 1 Drawing Sheet

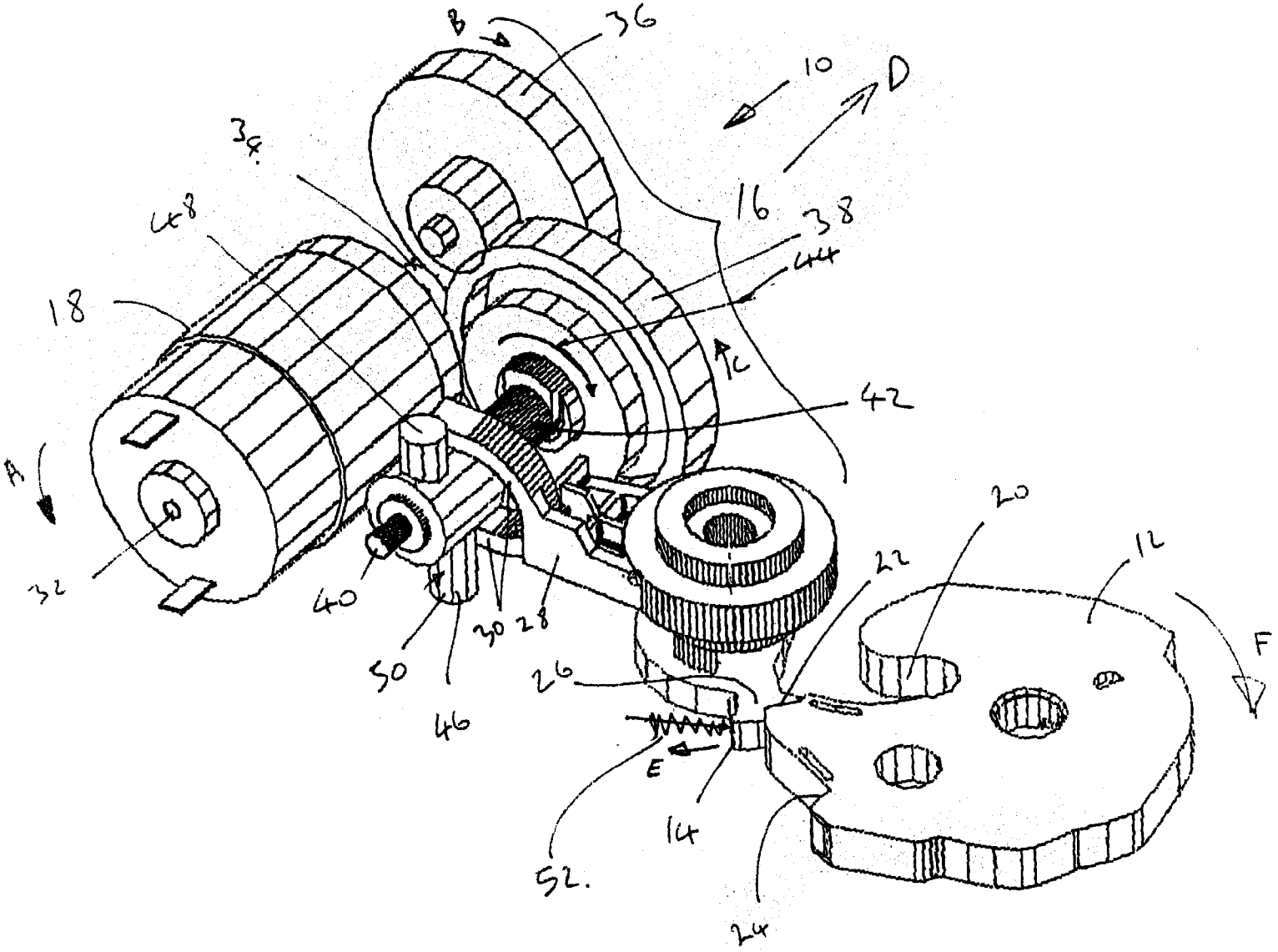
F
12
20
22
24
14
E
52
28
46
50
40
42
44
38
16
10
D
26
A
34
36
18
22
B

LATCH ARRANGEMENT

CROSS REFERENCE TO RELATED APPLICATIONS

This application claims priority from United Kingdom (GB) Patent Application No. 0118687.3 filed on Aug. 1, 2001.

BACKGROUND OF THE INVENTION

The present invention relates to latch arrangements, and in particular latch arrangements which can be power opened.

SUMMARY OF THE INVENTION

According to the present invention there is provided a latch arrangement including a latch bolt having at least an open and closed position for releasably retaining a striker in use, the latch bolt being releasably held in at least a closed position by a pawl, the pawl being operably connected to an actuator by a transmission path, such that powered actuation of the actuator causes the pawl to release the latch bolt for opening, the latch arrangement further including means operable to return the actuator to a rest position, independent of movement of the pawl, wherein there is a lost motion connection in the transmission path to provide for the return of the actuator to the rest position independent of movement of the pawl, the lost motion connection being in the form of an abutment on a nut in lost motion connection with a further abutment of the transmission path.

The inventive latch arrangement only requires powering in one direction. Furthermore, when the actuator in a rest condition, the pawl is independent from the actuator, thus allowing the pawl to properly engage the first safety abutment and/or closed abutment of the latch bolt.

The various features and advantages of this invention will become apparent to those skilled in the art from the following detailed description of the currently preferred embodiment. The drawings that accompany the detailed description can be briefly described as follows.

BRIEF DESCRIPTION OF THE DRAWING

FIG. 1 is an isometric view of a latch arrangement according to one embodiment of the invention.

DETAILED DESCRIPTION OF THE EMBODIMENTS

The invention will now be described, by way of example only, with reference to the FIG. 1.

FIG. 1 shows latch arrangement 10 including a latch bolt 12, a pawl 14, a transmission path 16 and an actuator 18. Further components of the actuator arrangement (such as the housing) have been omitted for clarity.

The latch bolt 12 includes a mouth 20 for releasably retaining a striker in use. Latch bolt 12 is rotatable between a closed position as shown in the figure and an open position. Latch bolt 12 includes a closed abutment 22 and a first safety abutment 24.

Pawl 14 includes an engagement arm 26 for engagement with closed abutment 22 or first safety abutment 24. Pawl 14 is rotatable from an engaged position as shown in the figure to a disengaged position where engagement arm 26 is disengaged from closed abutment 22 and first safety abutment 24.

The pawl 14 further includes a disengagement arm 28, the end of which is in the form of a yoke 30.

Actuator 18 is a power actuator, in this case, an electric motor. Mounted on the output shaft 32 of the motor is a gear pinion 34. Gear pinion 34 engages first reduction gear 36 which in turn engages second reduction gear 38. Second reduction gear 38 rotates about gear shaft 40, which includes a threaded portion 42. Mounted around gear shaft 40 is a coil spring 44 (shown schematically), one end of which is connected to gear shaft 40 and the other end of which is connected to the latch chassis (not shown).

A nut 46 is in threaded engagement with threaded portion 42 and includes opposing pins 48 and 50 which engage corresponding arms of yoke 30.

It will be noted that pin 50 is longer than pin 48 and that portion of pin 50 remote from shaft 40 further engages a slot (not shown) fixed relative to the chassis (not shown) of the latch arrangement, and aligned with the axis of shaft 40. As such nut 46 cannot rotate relative to shaft 40, but is free to translate length wise relative to shaft 40 as dictated by the threaded engagement of the nut with the threaded portion 42.

It can be seen that transmission path 16 therefore comprises at least gear pinion 34, first reduction gear 36, second reduction gear 38, threaded portion 42, nut 46, pins 48 and 50, yoke 30, and disengagement arm 28, these being components that operably connect the motor to the engagement arm 26 of the pawl.

Operation of the latch arrangement is as follows

As shown in the figure the latch arrangement is in a closed position.

When it is required to open the latch arrangement, the motor is powered such that output shaft 32 is caused to rotate in the direction of arrow A, causing first reduction gear 36 to rotate in the direction of arrow B, causing second reduction gear 38 to rotate in the direction of arrow C, causing nut 46 to translate in the direction of arrow D, causing yoke 30 to also translate in the direction arrow D, causing disengagement arm 28 and engagement arm 26 to both rotate in the direction of arrow E thus disengaging the pawl and hence allowing latch bolt 12 to rotate in the direction of arrow F to an open position whereupon a striker (not shown) is released.

It will be noted that coil spring 44 will have been wound up during this release movement because the movement direction is against the direction of the resilient force direction in the spring, causing energy to be stored therein.

Once the striker has been released, and the motor is no longer powered, the energy stored in coil spring 44 is released causing the nut 46, first and second reduction gears 36 and 38, gear pinion 34 and output shaft 32 to return to their at rest positions as shown in the figure.

However, it can be seen that the abutment of pins 48 and 50 with arms of yoke 30 is a lost motion connection and the action of returning nut 46 to its at rest position as shown in the figure does not cause yoke 30 to return to this position.

In fact yoke 30 is returned to this position by pawl spring 52 (shown schematically) which acts between engagement arm 26 and the chassis (not shown) of the latch arrangement. In particular when the latch bolt in its open position the actuator, when not powered, is in its rest position. When the associated door is closed and the latch bolt 12 is rotated to its closed position (as shown in the figure) the first safety abutment is initially caused to move past engagement arm 26, followed by the closed abutment. It will be appreciated that the pawl spring 52 causes the engagement arm 26 to sequentially engage firstly the first safety abutment and then the closed abutment. Because of the lost motion connection between yoke 30 and pins 48 and 50, engagement arm 26 can carry out this action independent of the motor.

Thus it can be seen that the motor only needs to be powered in one direction because the biasing force from the coil spring 44 returns the motor to its rest position.

Furthermore, once the motor is in its rest position, it does not interfere with the sequential engagement of the pawl with the first safety abutment and close abutment in view of the lost motion connection.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

We claim:

1. A latch arrangement, comprising:

a latch bolt having at least an open and closed position for releasably retaining a striker in use;

a pawl that releasably holds the latch bolt in at least a closed position an actuator, wherein the pawl is operably connected to the actuator by a transmission path such that powered actuation of the actuator causes the pawl to release the latch bolt for opening; and a return mechanism that returns the actuator to a rest position independent of movement of the pawl, wherein the return mechanism operates along a lost motion connection in the transmission path, the lost motion connection having an actuator side and a pawl side and comprising a first abutment on a nut disposed on the actuator side of the lost motion connection, and a yoke disposed in lost motion connection with the first abutment.

2. A latch arrangement as defined in claim 1, wherein the return mechanism is a resilient member.

3. A latch arrangement as defined in claim 2, wherein the resilient member is a spring.

4. A latch arrangement as defined in claim 2, wherein movement of the actuator from the rest position to an actuated position is against a resilient force direction of the resilient member, storing energy in the resilient member.

5. A latch arrangement as defined in claim 1, wherein movement of the actuator from the rest position to an actuated position stores energy in the return mechanism.

6. A latch arrangement as defined in claim 1, wherein the yoke is on the pawl side of the lost motion connection.

7. A latch arrangement as defined in claim 1, further comprising a resilient member that biases the pawl into engagement with the latch bolt.

8. A latch arrangement as defined in claim 7, wherein the resilient member is a pawl spring.

* * * * *

UNITED STATES PATENT AND TRADEMARK OFFICE

CERTIFICATE OF CORRECTION

PATENT NO. : 6,598,911 B2 
DATED : July 29, 2003
INVENTOR(S) : Veronique Mejean, Mathias Barth and Lutz Lorenz It is certified that error appears in the above-identified patent and that said Letters Patent is hereby corrected as shown below:

Title page,
Item [73], Assignee, "ArvinMeritor Light Vehicle Systems" should be
-- ArvinMeritor Light Vehicle Systems (UK) Ltd. --

Signed and Sealed this

Twenty-third Day of December, 2003

JAMES E. ROGAN
*Director of the United States Patent and Trademark Office*